US010001350B2

(12) United States Patent
Pearcey et al.

(10) Patent No.: US 10,001,350 B2
(45) Date of Patent: Jun. 19, 2018

(54) SHOOTING TARGET ASSEMBLY

(71) Applicant: Leroy Gene Pearcey, Dublin, TX (US)

(72) Inventors: Leroy Gene Pearcey, Dublin, TX (US); David Arnold Dransfield, Nampa, ID (US); Michael H. Gibson, Boise, ID (US)

(73) Assignee: Leroy Gene Pearcey, Dublin, TX (US)

( * ) Notice: Subject to any disclaimer, the term of this patent is extended or adjusted under 35 U.S.C. 154(b) by 0 days. days.

(21) Appl. No.: 15/702,999

(22) Filed: Sep. 13, 2017

(65) Prior Publication Data

US 2018/0120065 A1 May 3, 2018

Related U.S. Application Data

(60) Provisional application No. 62/416,868, filed on Nov. 3, 2016.

(51) Int. Cl.

| | |
|---|---|
| ***F41J 1/10*** | (2006.01) |
| *F41J 7/04* | (2006.01) |
| *F41J 1/00* | (2006.01) |

(52) U.S. Cl.

CPC .. *F41J 1/10* (2013.01); *F41J 1/00* (2013.01); *F41J 7/04* (2013.01)

(58) Field of Classification Search

CPC ..... F41J 1/10; F41J 1/00
USPC ..... 273/403–409, 390–392
See application file for complete search history.

(56) References Cited

U.S. PATENT DOCUMENTS

| | | | | |
|---|---|---|---|---|
| 1,103,579 | A * | 7/1914 | Hall | F41J 1/10 248/304 |
| 1,629,386 | A * | 5/1927 | Hummerson | F41J 7/04 273/390 |
| 2,085,933 | A * | 7/1937 | Vaughan | F41J 7/04 273/388 |
| 4,249,743 | A * | 2/1981 | Lee | F41J 7/04 273/391 |
| 4,266,780 | A * | 5/1981 | McQuary | F41J 3/0076 235/121 |
| 6,776,418 | B1 * | 8/2004 | Sovine | F41J 1/10 273/407 |

(Continued)

OTHER PUBLICATIONS

Hang Fast Steel Target Systems, "The Hang Fast Target System," https://hangfasttargets.com/about, (c) 2017, accessed Aug. 16, 2017.

*Primary Examiner* — Mark Graham
(74) *Attorney, Agent, or Firm* — Bennet K. Langlotz; Langlotz Patent & Trademark Works, Inc.

(57) ABSTRACT

Shooting target assemblies have a post element having spaced-apart upper first and second protrusions defining an elongated target receptacle slot, the target receptacle slot having a closed lower end and an open upper end, a target plate having a main portion and an elongated stem portion extending from the main portion, the stem portion having parallel stem legs spaced apart to define a stem slot, a bridge portion connected between the stem legs away from the main portion and defining a lower end of the stem slot, the stem slot of the target plate being adapted to closely receive one of the first and second protrusions of the post element, and the target receptacle slot of the post element being adapted to closely receive the bridge portion of the target plate. The target receptacle slot may have a slot width adapted to closely receive the bridge.

14 Claims, 9 Drawing Sheets

(56) References Cited

U.S. PATENT DOCUMENTS

| | | | | |
|---|---|---|---|---|
| 7,306,229 | B2 * | 12/2007 | Rolfe | F41J 7/04 273/391 |
| 7,325,808 | B1 * | 2/2008 | Adler | F41J 1/08 273/406 |
| 7,644,927 | B2 * | 1/2010 | Law | F41J 1/10 248/215 |
| 9,631,906 | B2 * | 4/2017 | English | F41J 5/052 |
| 9,746,291 | B1 * | 8/2017 | Crawford | F41J 5/18 |
| 9,784,538 | B2 * | 10/2017 | Sovine | F41J 1/10 |
| 2005/0001381 | A1 * | 1/2005 | Lambert | F41J 7/04 273/348 |
| 2007/0045965 | A1 * | 3/2007 | Bateman | F41J 1/10 273/407 |
| 2008/0272548 | A1 * | 11/2008 | Hensley | F41J 1/10 273/406 |
| 2010/0225063 | A1 * | 9/2010 | Wyrick | F41J 1/10 273/390 |
| 2012/0193872 | A1 * | 8/2012 | Henson | F41J 1/01 273/348 |
| 2013/0001880 | A1 * | 1/2013 | Dean | F41J 1/10 273/407 |
| 2013/0106059 | A1 * | 5/2013 | Larue | F41J 1/10 273/407 |
| 2014/0284879 | A1 * | 9/2014 | Hendrix | F41J 1/10 273/407 |
| 2014/0300055 | A1 * | 10/2014 | Papp | F41J 1/10 273/407 |
| 2015/0268013 | A1 * | 9/2015 | Heise | F41J 7/04 273/389 |
| 2016/0209182 | A1 * | 7/2016 | Sovine | F41J 1/10 |
| 2017/0336180 | A1 * | 11/2017 | Sun | F41J 1/10 |
| 2017/0350677 | A1 * | 12/2017 | Sovine | F41J 1/10 |

* cited by examiner

SHOOTING TARGET ASSEMBLY

FIELD OF THE INVENTION

The present invention relates to firearms, and more particularly to a shooting target assembly.

BACKGROUND OF THE INVENTION

Various assemblies for mounting or hanging steel shooting targets are well known in the art. While these generally function as intended, especially when the shooter is very accurate, they have many disadvantages that can comprise their safety and durability. Assemblies with wooden components can generate splinters or break when unintentionally struck by bullets. Assemblies with exposed chains, straps, wire, rope, or bolt heads can break or cause ricochets or bullet fragments to fly in unintended directions when struck by bullets. Assemblies with welds can potentially weaken targets in the welded area, causing the target to break or the weld to fail if struck by a bullet in that location. Several of these attachment methods also require tools and significant amounts of time to replace or adjust the target.

Therefore, a need exists for a new and improved shooting target assembly that avoids fasteners and welds to secure the target plate to the assembly. In this regard, the various embodiments of the present invention substantially fulfill at least some of these needs. In this respect, the shooting target assembly according to the present invention substantially departs from the conventional concepts and designs of the prior art, and in doing so provides an apparatus primarily developed for the purpose of avoiding fasteners and welds to secure the target plate to the assembly.

SUMMARY OF THE INVENTION

The present invention provides an improved shooting target assembly, and overcomes the above-mentioned disadvantages and drawbacks of the prior art. As such, the general purpose of the present invention, which will be described subsequently in greater detail, is to provide an improved shooting target assembly that has all the advantages of the prior art mentioned above.

To attain this, the preferred embodiment of the present invention essentially comprises a post element having spaced-apart upper first and second protrusions defining an elongated target receptacle slot, the target receptacle slot having a closed lower end and an open upper end, a target plate having a main portion and an elongated stem portion extending from the main portion, the stem portion having parallel stem legs spaced apart to define a stem slot, a bridge portion connected between the stem legs away from the main portion and defining a lower end of the stem slot, the stem slot of the target plate being adapted to closely receive one of the first and second protrusions of the post element, and the target receptacle slot of the post element being adapted to closely receive the bridge portion of the target plate. The target receptacle slot may have a slot width adapted to closely receive the bridge. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
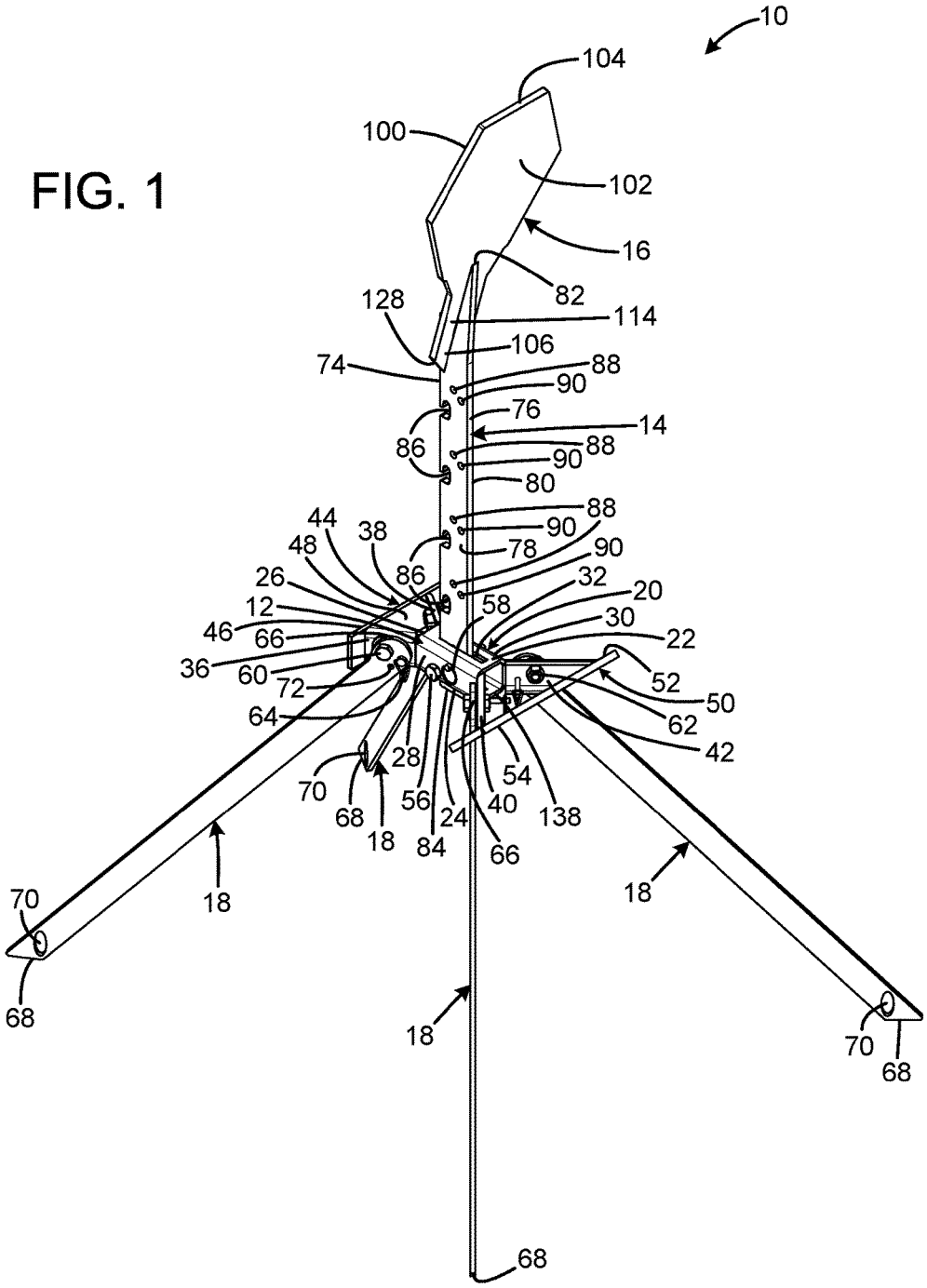
FIG. 1 is a front isometric view of the current embodiment of the shooting target assembly constructed in accordance with the principles of the present invention.

An embodiment of the shooting target assembly of the present invention is shown and generally designated by the reference numeral 10.

Figure 2:
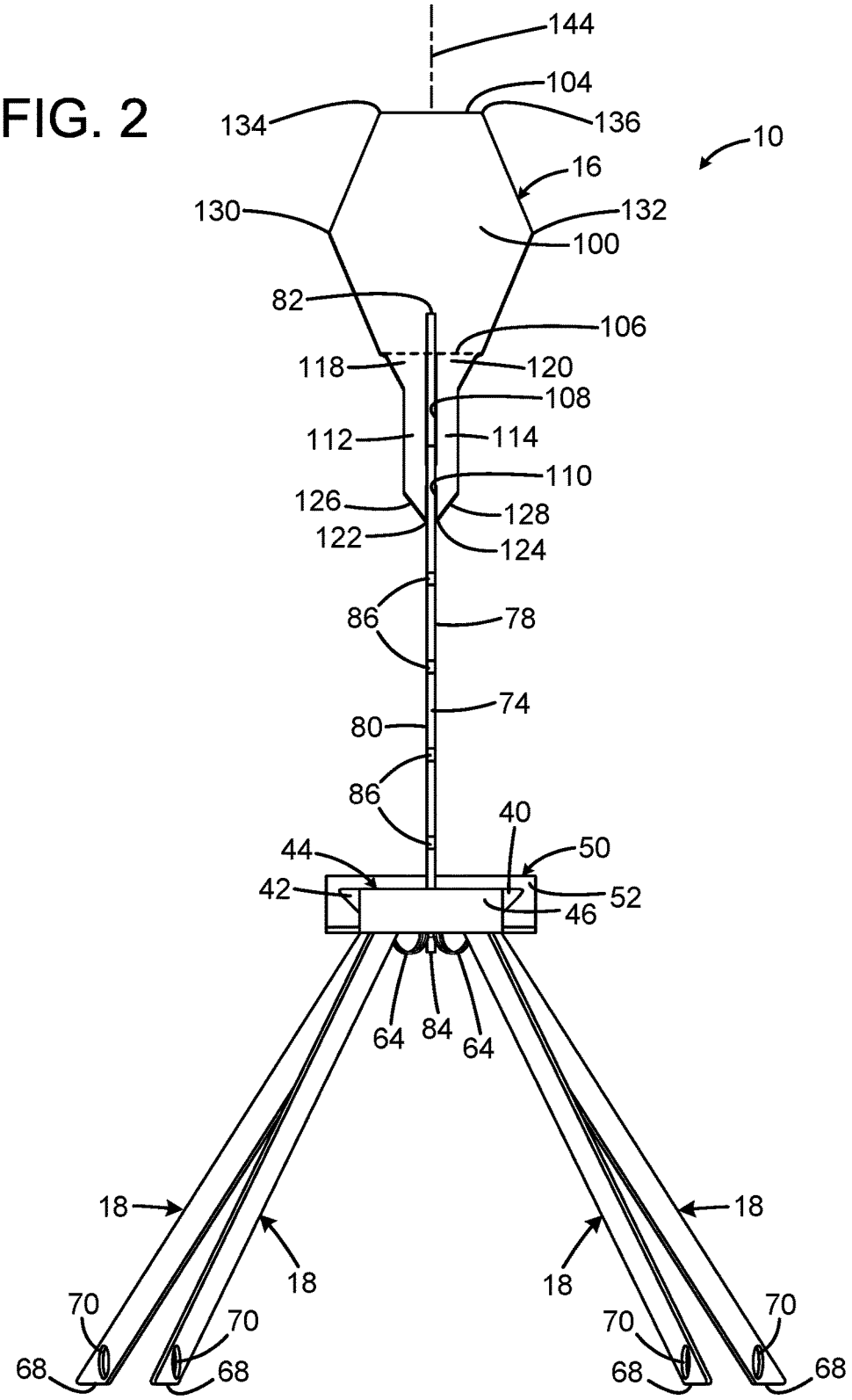
FIG. 2 is rear view of the shooting target assembly of FIG. 1.
Figure 3:
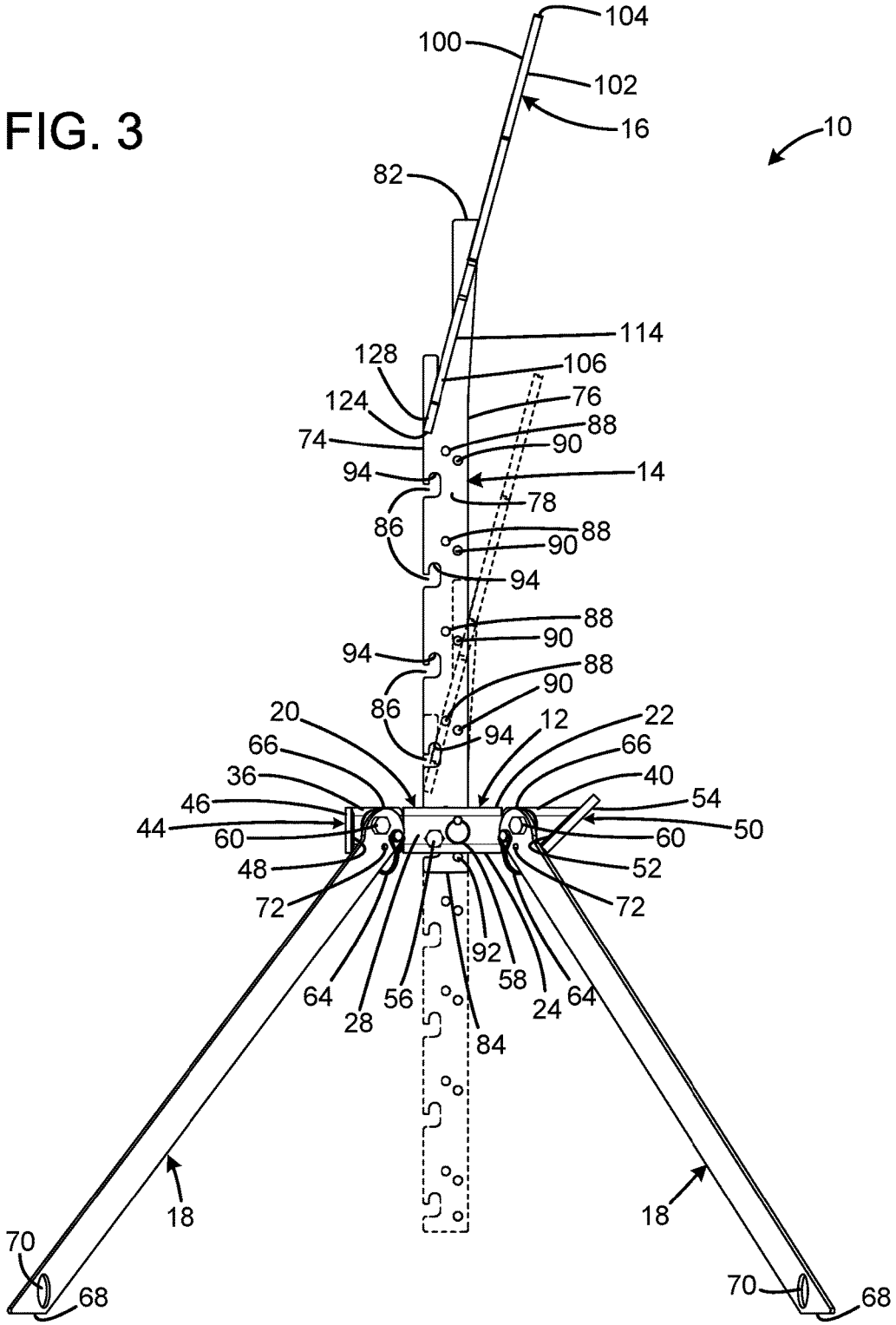
FIG. 3 is a left side view of the shooting target assembly of FIG. 1 with dashed lines denoting the range of height adjustment of the post and target.
Figure 4:
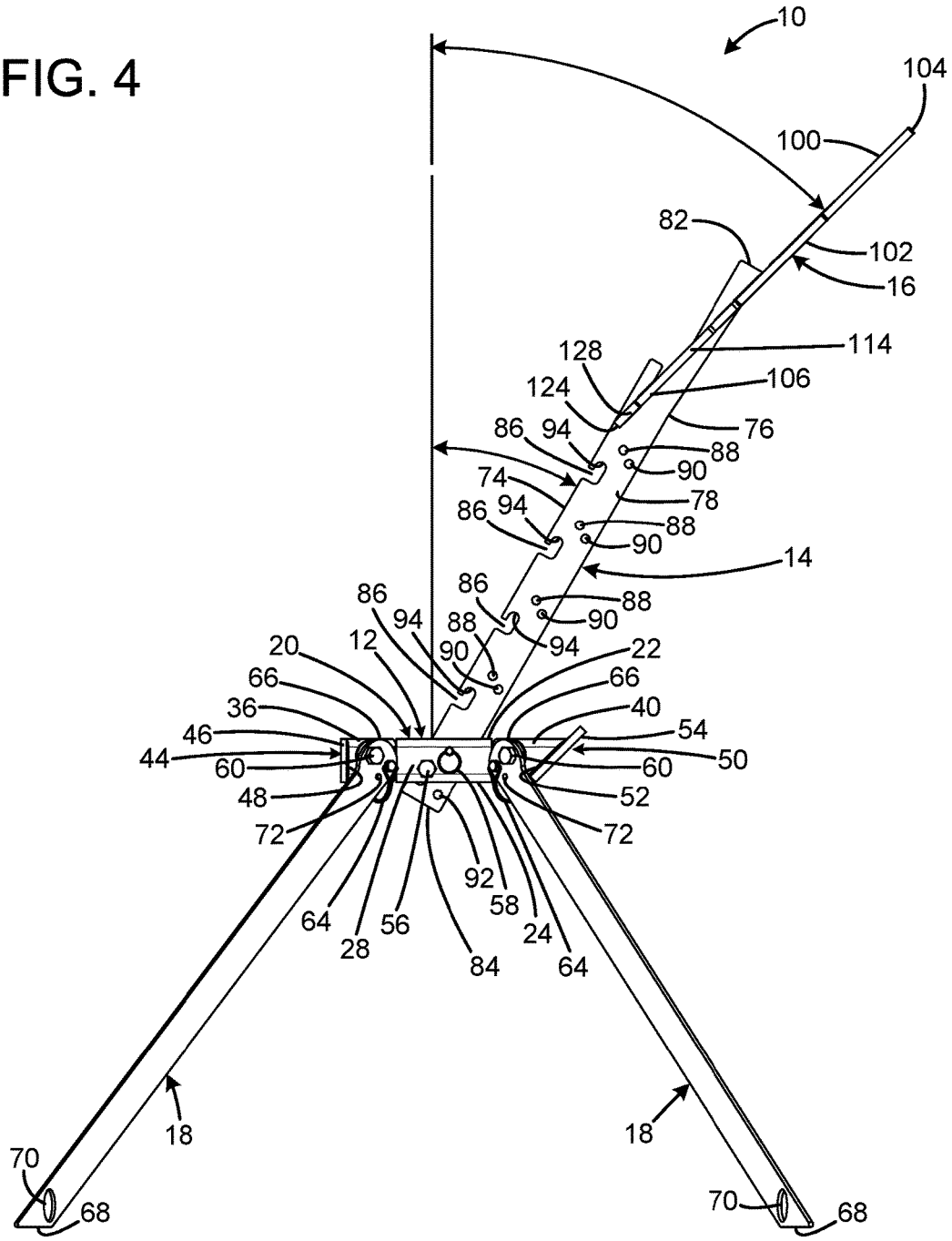
FIG. 4 is a left side view of the shooting target assembly of FIG. 1 showing the range of angle adjustment of the post and target.
Figure 5:
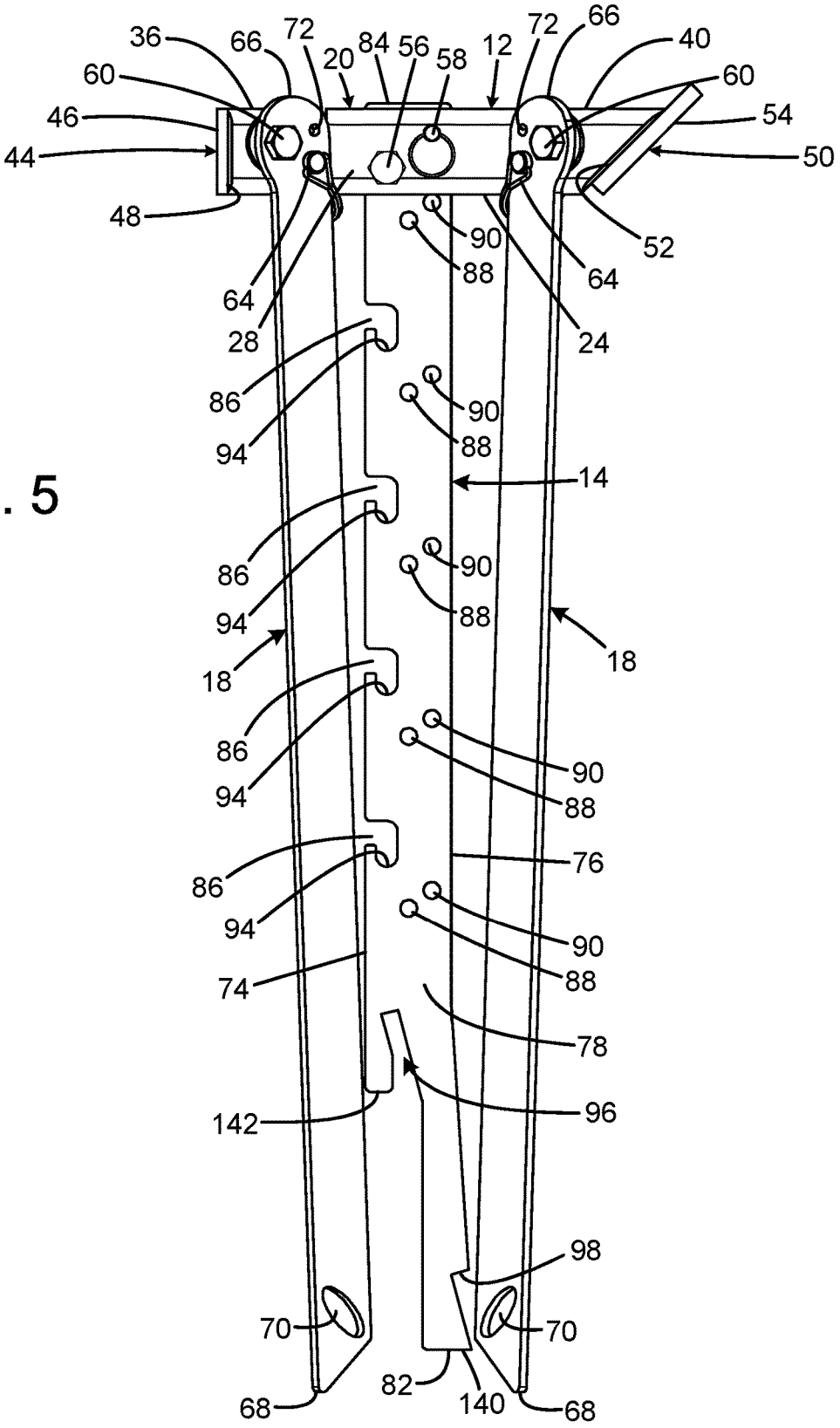
FIG. 5 is a left side view of the shooting target assembly of FIG. 1 in the collapsed position.
Figure 6:
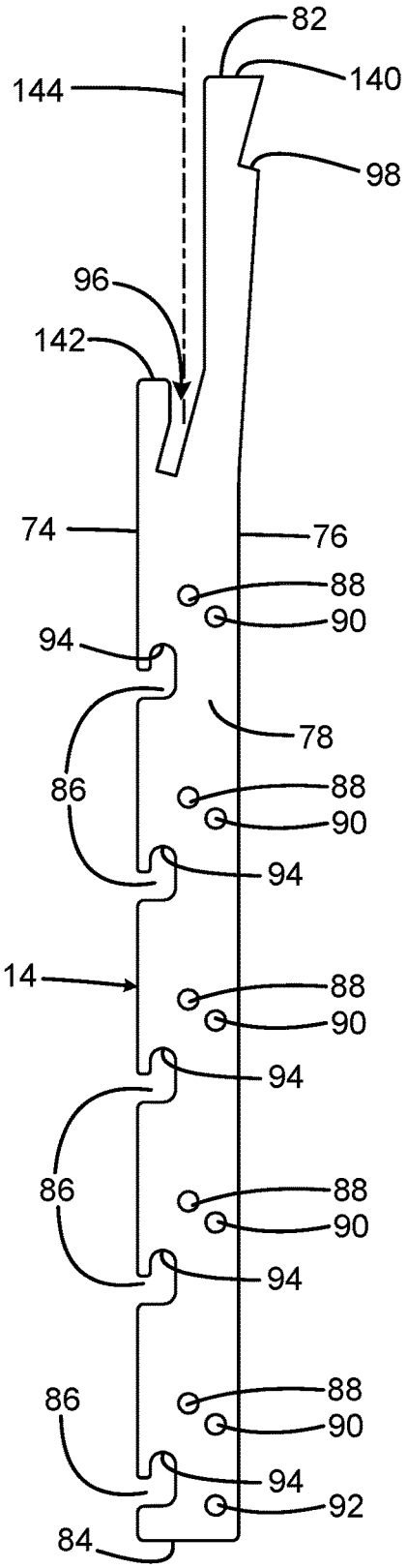
FIG. 6 is a left side view of the post of FIG. 1 removed from the shooting target assembly.
Figure 7:
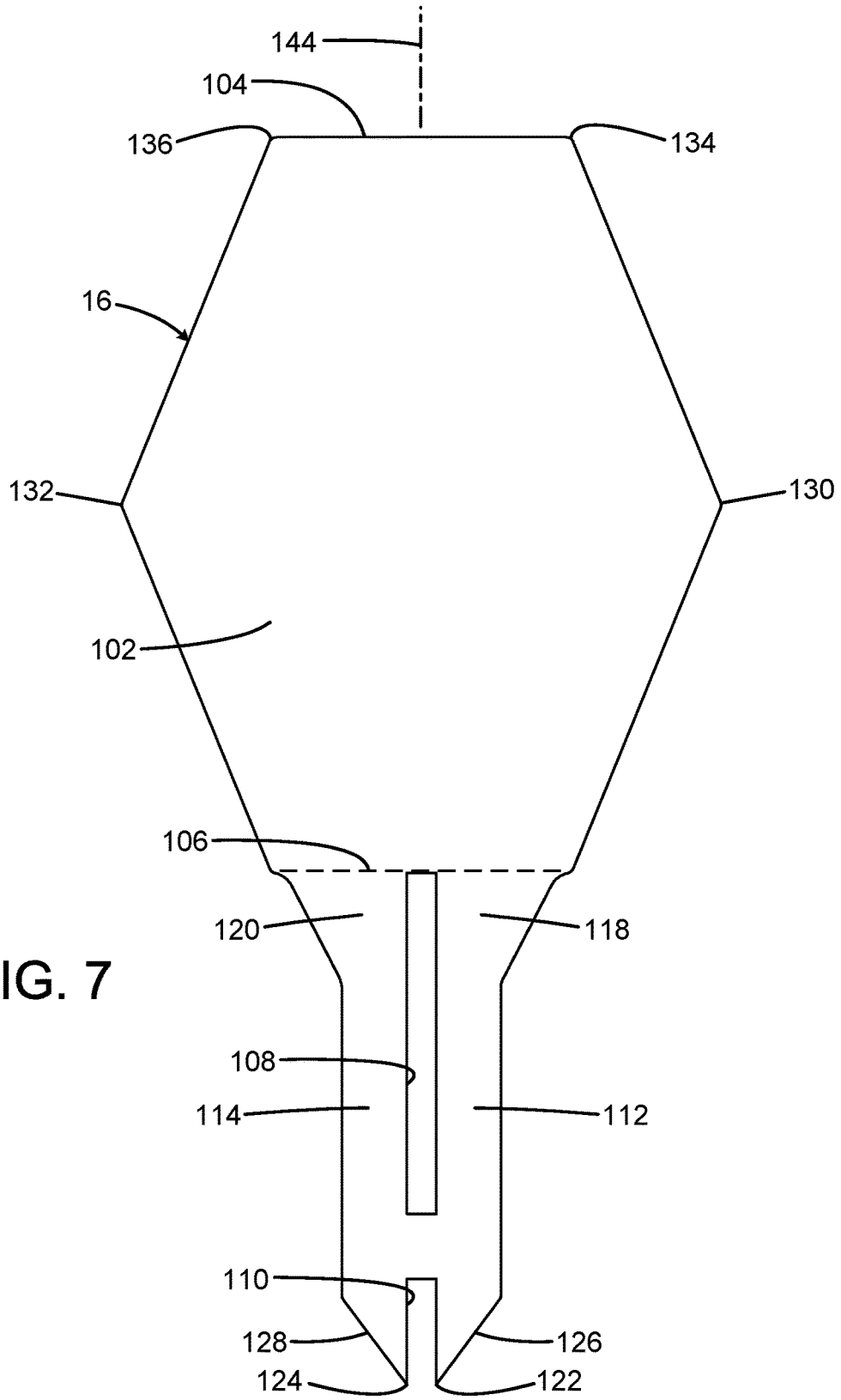
FIG. 7 is a front view of the target of FIG. 1 removed from the shooting target assembly.
Figure 8:
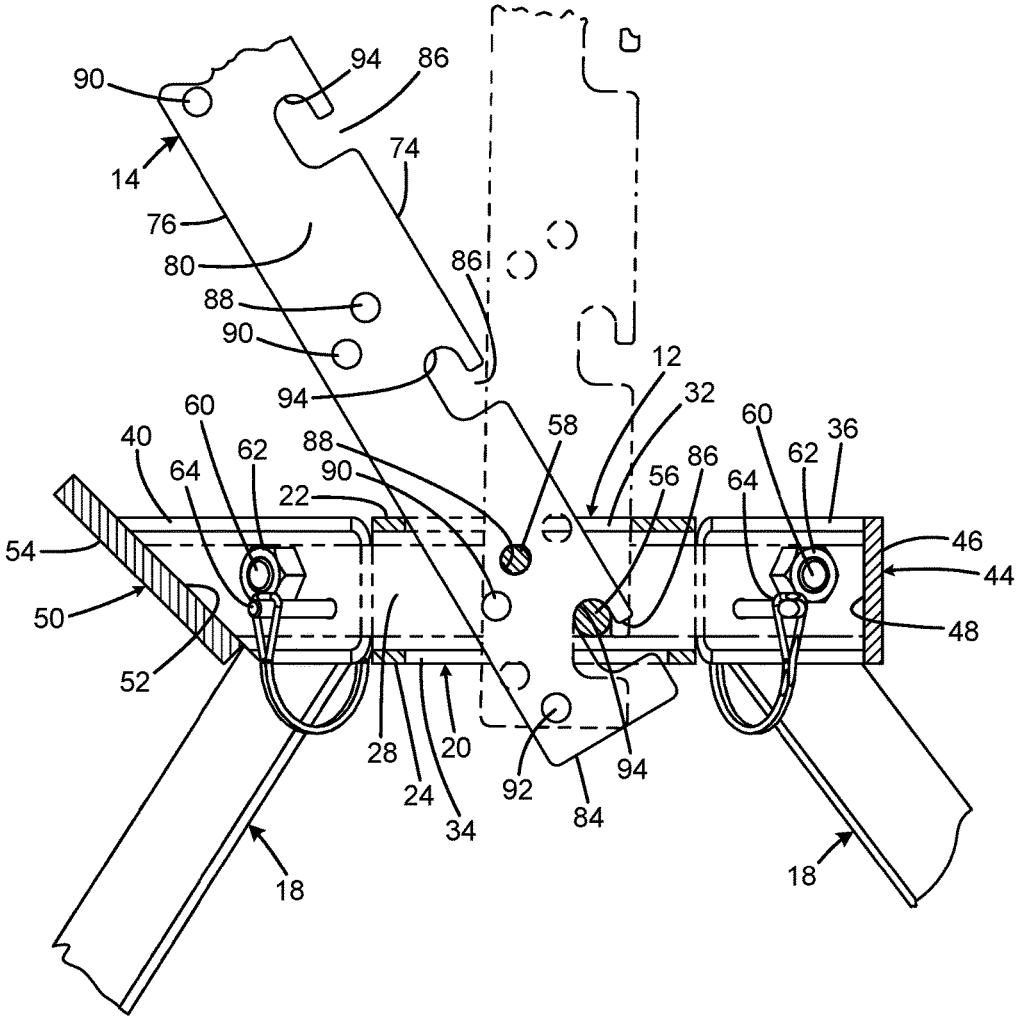
FIG. 8 is a right side sectional fragmentary view of the shooting target assembly of FIG. 1 showing the range of angle adjustment of the post.
Figure 9:
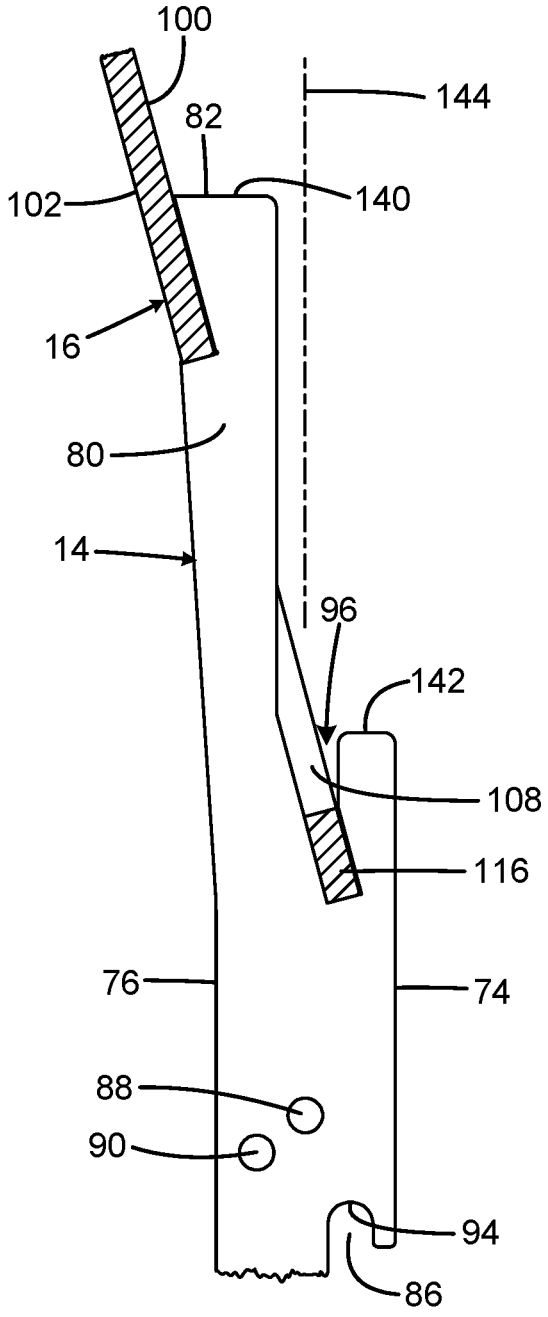
FIG. 9 is a right side sectional fragmentary view of the shooting target assembly of FIG. 1 showing the target being received by the top of the post.

FIGS. 1-9 illustrate the improved shooting target assembly 10 of the present invention. More particularly, the shooting target assembly is shown in the deployed position in FIGS. 1-4 and has a central body weldment 12, a post 14, a target 16, and legs 18. Four legs are used for greater stability and strength. None of the legs are in the centerline of the target, which reduces the potential for bullet strike damage and ricochets.

The body weldment 12 has a central square tubing portion 20 having a top 22, bottom 24, rear 26, left side 28, right side 30. The top and the bottom of the central square tubing portion each define a central longitudinal slot 32, 34 (slot 34 in the bottom of the central square tubing portion is visible in FIG. 8). Alternatively, a structure of any desired shape capable of defining a slot can be used instead of the square tubing described. A left rear arm 36 and a right rear arm 38 extend outwards from the rear of the central tubing portion at an angle of 33°. A left front arm 40 and a right front arm 42 extend outwards from the front 138 of the central tubing portion at an angle of 45°. A rear plate 44 having a rear 46 and a front 48 is attached by the front to the left rear arm and right rear arm in a vertical orientation. A front plate 50 having a rear 52 and a front 54 is attached by the front to the left front arm and right front arm at an angle of 45° to deflect bullets and bullet fragments hitting the front plate downward. This provides a high level of protection for the central tubing portion and its attached components. The front plate and rear plate are gussets that strengthen the body weldment and protect the body weldment and its attached components and fasteners from bullet strikes. The front and rear plates also serve as stops that limit how far out the legs 18 can splay. In the current embodiment, the body weldment including the front and rear plates has a maximum width of 9½ inch (the width of the front plate), a maximum height of 2⁹⁄₁₆ inch, and a maximum length of 11⁵⁄₁₆ inch. The rear plate has a width of 6½ inch. The central tubing portion has two pairs of axially registered apertures on the left and right sides (not visible). The lower, rearwardmost pair of apertures receive a bolt 56 secured by a nut (not visible). The upper, central pair of apertures receive a ring pin 58. Each of the arms has a pair of apertures (not visible). A larger, upper aperture receives a bolt 60 secured by nut 62. A smaller, lower aperture receives a basket clip 64. In the current embodiment, the body weldment is made of steel.

Each of the legs 18 has a top 66 and a bottom 68 and extends downwardly from the body weldment 12. The bottom of each leg is angled to be approximately horizontal when the legs are fully splayed. The bottom of each leg has an aperture 70. The aperture 70 can be used to secure the bottom of each leg to the ground or other flooring surface. The top of each leg has an aperture (not visible) that receives a bolt 60 to secure the leg to the body weldment. A second pair of apertures (aperture 72 is visible) are also present in the top of each leg. A basket clip 64 is received by a selected one of the second pair of apertures. The top of each leg is rounded so the legs can pivot freely about the bolt 60 within the constraints of the rear and front plates 44, 50 and the basket clips 64. The legs have a range of movement that extends from the fully splayed position shown in FIGS. 1-4 to a collapsed position suitable for storage and transport shown in FIG. 5. The basket clips can be used to lock the legs in the closed (folded) position for compact storage or transport. The basket clips can also be used to lock the legs in the open (deployed) position to make repositioning the target over short distances easier by preventing the legs from folding during repositioning. In addition, when the basket clips lock the legs in the open position, the legs cannot be moved to a folded position by heavy impact. For example, even if the target is hit by an extremely heavy round that rocks the target back so strongly that the front legs lift off the ground, the legs will come back down fully opened.

The post 14 is an element that extends upwards from the body weldment 12 when the shooting target assembly 10 is in use. The post is received within the slots 32, 34 in the central square tubing portion 20. The slots are longer than the post is wide, thereby permitting the post to pivot within the slots. Forward tilt of the post is limited to 30° by the front of the slot 32 and the rear of the slot 34. Rearward movement of the post is stopped at the vertical position by the rear of the slot 32. The post has a rear 74, front 76, left side 78, right side 80, top 82, and bottom 84. The rear of the post defines a plurality of notches 86 and a plurality of aperture pairs 88, 90. In the current embodiment, the notches have entrances located at 0.966 inch, 4.966 inch, 8.966 inch, 12.966 inch, and 16.966 inch relative to the bottom of the post. The aperture pairs are located at 2.304 and 2.720 inch, 6.304 and 6.720 inch, 10.304 and 10.720 inch, 14.304 and 14.720 inch, and 18.304 and 18.720 inch relative to the bottom of the post. The apertures 88 are located 1.005 inch behind the rear of the post. The apertures 90 are located 1.547 inch behind the rear of the post. An additional aperture 92 is located at 0.696 inch relative to the bottom of the post and 1.547 inch from the rear of the post. The post has a width of 2 inch and a maximum length of 29 inch.

Each of the notches 86 has a pocket 94 that is rounded to closely receive the bolt 56 while permitting the post to pivot about the bolt within the constraints of the slots 32, 34. The slots are sized so the post is vertical or tilted forward at an angle of 30° relative to the top of the body weldment. The centerline of the pockets is located 0.500 inch from the rear 74 of the post. The selected notch that receives the bolt determines the height the post extends above the body weldment 12 (illustrated by the dashed lines in FIG. 3). The ring pin 58 is inserted through a selected aperture of the aperture pair 88, 90 adjacent to the selected notch. The apertures 88 secure the post at an angle of 30° relative to the top 22 of the body weldment 12 (shown in FIGS. 4 and 8) with the post tilted forward. The apertures 90 secure the post vertically relative to the top of the body weldment. The forward tilt position is used with more powerful ammunition to prevent excessive damage to the target 16 and minimize splatter of bullet fragments back towards the shooter. The post can also be left unpinned in the forward 30° position so the target and post can rock backward under impact until the post returns to the vertical position to further reduce the effect of heavy ammunition and splattering of bullet fragments. The target and post will subsequent rock back forward to the 30° forward tilt position of the post under the influence of gravity, thereby avoiding having to reset the target manually. The additional aperture 92 is used when the shooting target assembly 10 is in the collapsed position shown in FIG. 5 with the target 16 removed from the post. In the collapsed position, the ring pin is inserted through aperture 92 to secure the post in a downwardly pointed vertical position with the bolt 56 received in the entrance of the notch closest to the bottom 84 of the post. The height and tilt of the post can be easily changed without tools. The shooting target assembly can also be transitioned between the deployed and collapsed positions without tools.

The top 82 of the post 14 has spaced-apart upper first and second protrusions that define a rear angled slot/elongated target receptacle slot 96 and a front angled notch 98 that receive the target 16. The rear angled slot has a closed lower end and an open upper end. The post is an elongated body that defines a post axis 144. The rear angled slot is inclined with respect to the post axis. The post defines a forward direction and has a forward free end protrusion 140 and a rear free end protrusion 142 that define the rear angled slot. The forward free end protrusion extends beyond the rear free end protrusion. The forward free end protrusion has a rearward face in part defining the rear angled slot, and a forward face defining an upward facing notch surface (the front angled notch). In the current embodiment, the front angled notch extends from 27.144 inch to 29.000 inch relative to the bottom 84 of the post, with an inflection point at 27.250 inch relative to the bottom of the post. The inflection point has an angle θ 0.031 centered at virtual sharp. The rear of the rear angled slot extends from 21.195 inch to 22.161 inch relative to the bottom of the post and below the top of the rear free end protrusion. The front of the rear angled slot extends from 21.093 inch to 23.212 inch relative to the bottom of the post and below the top of the forward free end protrusion. The bottom of the rear angled slot extends from 0.378 inch to 0.636 inch from the rear of the post. The top of the rear angled slot extends from 0.636 inch to 1.327 inch from the rear of the post.

The target 16 is a plate with a main portion having a rear 100, front 102, top 104, and bottom 106. The portion of the target below the bottom (denoted by the dashed line 106 in FIG. 7) is a stem portion bifurcated by an upper slot/stem slot 108 and a lower slot/end slot 110 into parallel stem legs (a right leg 112 and a left leg 114) that are spaced apart to define the upper slot/stem slot. The upper slot is prevented from communicating with the lower slot by a bridge portion 116 connecting between the stem legs away from the main portion between the upper and lower slots. The bridge defines the lower end of the upper slot. The free end of the stem portion defines the lower slot. The upper slot is aligned with the lower slot. The tops 118, 120 of the legs taper inwards, and the bottoms 122, 124 of the legs terminate in opposed tapered/angled elements 126, 128 that define the lower slot between them. The bottom of the lower slot is open so the legs 112, 114 can straddle the top 82 of the post 14 immediately below the front angled slot 96. The legs 112, 114 prevent twisting and misalignment of the target on the post when struck by hits on the main portion of the target. The bridge is received within the front angled slot. The forward free end protrusion of the post extends to a limited height below the level of the main portion of the target. The rear free end protrusion extends to a selected height above the level of a lower perimeter of the main portion of the target. The bridge has a bridge thickness and the front angled slot has a slot width adapted to closely receive the bridge. The upper slot of the target is adapted to closely receive one of the first and second protrusions of the post. The bottom of the angled notch 98 abuts the top of the upper slot, which transfers the force of bullet impact from the target to the top post section above the angled notch without overloading the bridge. Thus, the target is firmly secured to the top of the post at an angle of 15° relative to the post with the target tilted forward and capable of withstanding bullet strikes without requiring any fasteners, welds, or tools. The target is tilted forward to deflect bullets and bullet fragments downward. The target can be quickly installed, removed, or switched to a different target. The target is also reversible so the front and the rear can be positioned to face the shooter to receive bullet strikes. In the current embodiment, the target is a vertically elongated hexagon so the target appears to be a conventional hexagon when viewed from the front when tilted forward at an angle of 45° relative to the top 22 of the body weldment 12. The legs 112, 114 extend 7.875 inch from the bottom of the target. The middle vertices 130, 132 are located 5.657 inch above the bottom of the target. The upper vertices 134, 136 are located 11.914 inch above the bottom of the target. The target has an overall height of 19.189 inch including the legs 112, 114 and a maximum width of 9.238 inch. The upper slot has a length of 5¼ inch and a width of 0.45 inch. The bridge has a height of 1 inch and a width of 0.45 inch. The lower slot has a height of 1.625 inch and a width of 0.45 inch. In an alternative embodiment, the portion of the legs 112, 114 extending below the bridge of the target can be eliminated.

In the current embodiment, in the deployed position with the post vertical so the target is tilted forward at 15° relative to the top of the body weldment, the shooting target assembly has a maximum height of 57¾ inch with the post mounted on the body weldment bolt in the lowest notch. The shooting target assembly has a minimum height of 41¾ inch with the post mounted on the body weldment bolt in the highest notch with the post vertical so the target is tilted forward at 15° relative to the top of the body weldment. The bottom of the post is 3⅝ inch above the bottom of the legs when the shooting target assembly is in the minimum height deployed position. The target has a maximum forward tilt of 45° relative to the top of the body weldment when the post in the forward tilt position previously described. In the collapsed position with the target removed from the post, the shooting target assembly has a maximum height of 30⁷⁄₁₆ inch, a maximum width of 9½ inch, and a maximum depth of 11⁵⁄₁₆ inch.

While a current embodiment of a shooting target assembly has been described in detail, it should be apparent that modifications and variations thereto are possible, all of which fall within the true spirit and scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shooting target assembly comprising:

a post element having spaced-apart upper first and second protrusions defining an elongated target receptacle slot;

the target receptacle slot having a closed lower end and an open upper end;

a target plate having a main portion and an elongated stem portion extending from the main portion;

the stem portion having parallel stem legs spaced apart to define a stem slot;

a bridge portion connected between the stem legs away from the main portion and defining a lower end of the stem slot;

the stem slot of the target plate being adapted to closely receive one of the first and second protrusions of the post element; and the target receptacle slot of the post element being adapted to closely receive the bridge portion of the target plate.

2. The shooting target assembly of claim 1 wherein the target receptacle slot has a slot width adapted to closely receive the bridge.

3. The shooting target assembly of claim 1 wherein the bridge has a bridge thickness and the target receptacle slot having a slot width adapted to closely receive the bridge.

4. The shooting target assembly of claim 1 wherein the stem portion has a free end defining an end slot, with the bridge being between the end slot and the stem slot.

5. The shooting target assembly of claim 4 wherein the end slot is aligned with the stem slot.

6. The shooting target assembly of claim 4 wherein the free end comprises opposed tapered elements with the end slot defined between the tapered elements.

7. The shooting target assembly of claim 1 wherein the post element is an elongated body defining a post axis, and wherein the target receptacle slot is inclined with respect to the post axis.

8. The shooting target assembly of claim 1 wherein the post element defines a forward direction and having a rear free end protrusion and a forward free end protrusion defining the target receptacle slot.

9. The shooting target assembly of claim 8 wherein the forward free end protrusion extends beyond the rear free end protrusion.

10. The shooting target assembly of claim 9 wherein the rear free end protrusion extends to a limited height below the level of the main portion of the target.

11. The shooting target assembly of claim 9 wherein the forward free end protrusion extends to a selected height above the level of a lower perimeter of the main portion of the target.

12. The shooting target assembly of claim 8 wherein the forward free end protrusion has a rearward face in part defining the target receptacle slot, and a forward face defining an upward facing notch surface.

13. The shooting target assembly of claim 12 wherein the notch surface is adapted to be positioned proximate to a slot limit surface defining an upper limit of the stem slot.

14. The shooting target assembly of claim 12 wherein the notch surface is perpendicular to the target receptacle slot.

* * * * *